US006994182B2

(12) United States Patent
Wang

(10) Patent No.: US 6,994,182 B2
(45) Date of Patent: Feb. 7, 2006

(54) ESCAPE DEVICE FOR BUILDING

(76) Inventor: Wusheng Wang, No. 75, Du Jia Bang Road, Si Jing Town, Songjiang District, Shanghai 201601 (CN)

( * ) Notice: Subject to any disclaimer, the term of this patent is extended or adjusted under 35 U.S.C. 154(b) by 0 days.

(21) Appl. No.: 10/496,606

(22) PCT Filed: Sep. 13, 2002

(86) PCT No.: PCT/CN02/00654

§ 371 (c)(1),
(2), (4) Date: May 19, 2004

(87) PCT Pub. No.: WO03/043699

PCT Pub. Date: May 30, 2003

(65) Prior Publication Data

US 2004/0262083 A1 Dec. 30, 2004

(30) Foreign Application Priority Data

Nov. 20, 2001 (CN) ..... 01139933 A

(51) Int. Cl.
*A62B 1/20* (2006.01)
*A62B 1/06* (2006.01)

(52) U.S. Cl. ..... 182/48; 182/70

(58) Field of Classification Search ..... 182/48, 182/47, 70; 187/419
See application file for complete search history.

(56) References Cited

U.S. PATENT DOCUMENTS

| | | | | | |
|---|---|---|---|---|---|
| 4,099,595 | A | * | 7/1978 | Tracy | 182/48 |
| 4,099,596 | A | | 7/1978 | Tracy | |
| 4,240,520 | A | * | 12/1980 | LaGrone et al. | 182/48 |
| 4,778,031 | A | * | 10/1988 | Curiel | 182/47 |

FOREIGN PATENT DOCUMENTS

| | | | | |
|---|---|---|---|---|
| CN | 2031695 | U | | 2/1989 |
| CN | 2043511 | U | | 8/1989 |
| CN | 2338032 | Y | | 9/1999 |
| GB | 2232138 | A | * | 12/1990 |
| WO | WO9722514 | A | | 6/1997 |

* cited by examiner

*Primary Examiner*—Hugh B. Thompson, II
(74) *Attorney, Agent, or Firm*—East IP Group; Philip K. Yu; Anwu Wang

(57) ABSTRACT

A safety device for escaping from building, which includes a flexible tube-shaped object (8), interval installing elastic apparatus (6) longitudinal along the flexible tube-shaped object (8), a supporting frame (9) installed on the top of said flexible tube-shaped object (8), escaping entry (11) installed on the supporting frame (9). Using the safety device according to the present invention, people can safely descend onto the ground from the high building through said flexible tube-shaped object (8), when the accident occurs in the building.

9 Claims, 4 Drawing Sheets

ESCAPE DEVICE FOR BUILDING

This application is the national phase under 35 U.S.C. §371 of PCT International Application No. PCT/CN02/00654 which has an International filing date of Sep. 13, 2002, which designated the United States of America.

BACKGROUND OF THE INVENTION

1. Field of the Invention

The invention relates generally to escape devices for buildings, more particularly, it relates to a chute-type escape device through which individuals can escape by the gravitational force exerted upon their bodies.

2. Description of the Related Art

Nowadays, various means of emergency escape devices, such as scaling ladder, security rope, and even helicopter are provided for use in buildings and multi-story buildings to prevent or minimize injuries resulting from disasters such as fires. All of these conventional escape devices have disadvantages in providing protection for the people especially when they jump out of the building in course of the fluster evacuation. For example, a security-landing device for high place escape is disclosed in China utility model patent No. CN 2298823, which implements rope and security-landing device for evacuation from the high altitude. The security-landing device has too many components to handle during evacuation. For people who suffer from acrophobia, it is more inconvenient to use. Hence, a reliable emergency escape device for use in buildings and especially multi-story buildings is required to overcome the disadvantages of the conventional escape devices.

SUMMARY OF THE INVENTION

An objective of the present invention is to provide an escape device overcoming the disadvantages of the conventional escape devices, which has a reliable structure to implement safely and conveniently.

To obtain the above objective, an escape device of the present invention for use in building comprises a flexible tube, and a plurality of retractable elastic members laterally and intermittently formed on the flexible tube. The flexible tube is vertically oriented with a bracket formed on a top portion thereof. The bracket has an escape entrance formed thereon.

According to another aspect of the escape device of the present invention, the flexible tube is made of antisepsis, fireproofing fabric or unwoven fabric. The diameter of the flexible tube is between 30 centimeters to 80 centimeters. The space between the adjacent elastic members made of coil spring or snake-shaped spring is between 40 centimeters to 80 centimeters.

According to still another aspect of the escape device of the present invention, the escape device is hanged on the building by the bracket. The escape entrance is formed on a side of the bracket. Furthermore a joint opening is on the top of the bracket, and the plurality of the flexible tubes are vertically aligned so that bottom end of the upper flexible tube extends across the joint opening of the bracket formed on the top portion of the lower flexible tube and into the lower flexible tube.

According to still another aspect of the escape device of the present invention, the vertically aligned flexible tubes are positioned in escape channel which is opened vertically in the multi-story building, and one bracket of the flexible tube is disposed corresponding to one emergency exit defined in each story of the multi-story building. The flexible tube is hanged in the escape channel by the bracket. A landing pad is provided beneath the lowest flexible tube. A security gate is on bottom of the escape channel.

According to still another aspect of the escape device of the present invention, an escape indicating device is provided on the emergency exit defined in each story of the multi-story building.

According to still another aspect of the escape device of the present invention, a base is provided on the top floor of the building for supporting the escape device. The base comprises an actuating device and a reel actuated by the actuating device through a transmission device. At least two tow ropes and the flexible tub fixed and arranged parallel thereto are capable of being coiled on the reel. A top end of the flexible tube is fixed on the tow ropes via the bracket, and a bottom end of the flexible tube is fixed on the tow ropes via a fixing member.

According to still another aspect of the escape device of the present invention, tow rope 12 is steel wire or fireproofing rope.

According to still another aspect of the escape device of the present invention, four tow ropes are arranged in parallel with each other and oriented outside of the flexible tube in uniformity. The tow rope is steel wire or fireproofing rope. The connecting member is hook shaped.

According to still another aspect of the escape device of the present invention, the plurality of the flexible tubes are vertically aligned so that bottom end of the upper flexible tube extends across the joint opening of the bracket formed on the top portion of the lower flexible tube and into the lower flexible tube.

According to still another aspect of the escape device of the present invention, the landing speed of user in the flexible tube is between 0 meter per second to 2.5 meters per second.

Therefore, the escape device for use in building or multi-story building of the present invention has a compact structure to use conveniently and reliably. The landing speed of user in the flexible tube is varied between 0 meter per second to 2.5 meters per second because the user in the flexible tube can manage the elastic member to control the landing speed for safe landing. Additionally, the user can only see the interior of the flexible tube while falling, thereby eliminating fear of the user.

Other objects, advantages and novel features of the invention will become more apparent from the following detailed description of the present embodiment when taken in conjunction with the accompanying drawings.

DESCRIPTION OF THE PREFERRED EMBODIMENTS

Figure 1:
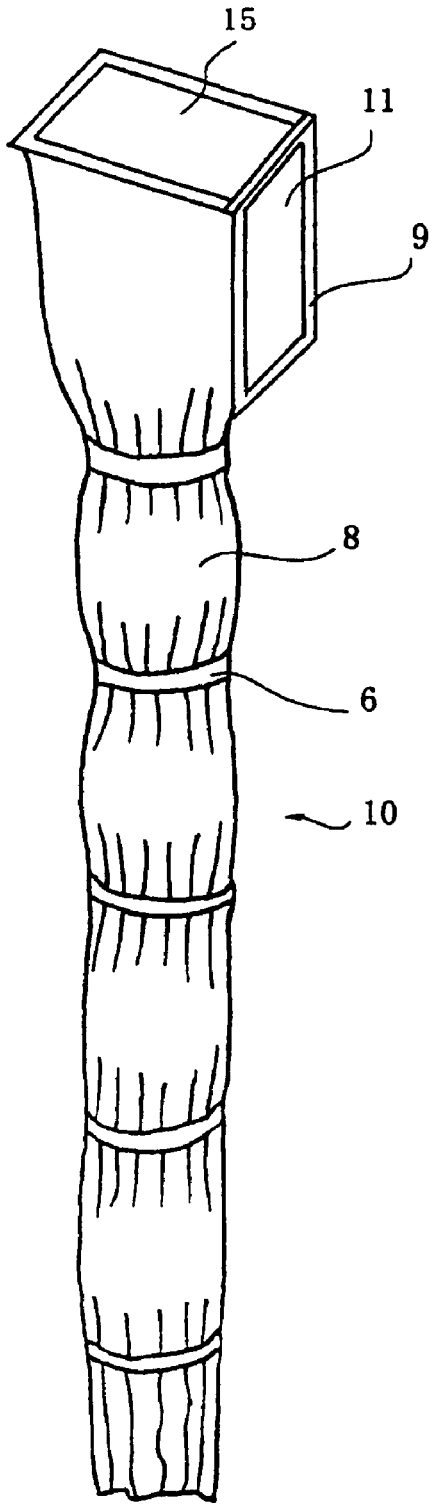
FIG. 1 is a perspective view of a flexible tube of a chute-type escape device for use in buildings or multi-story buildings.
Figure 2:
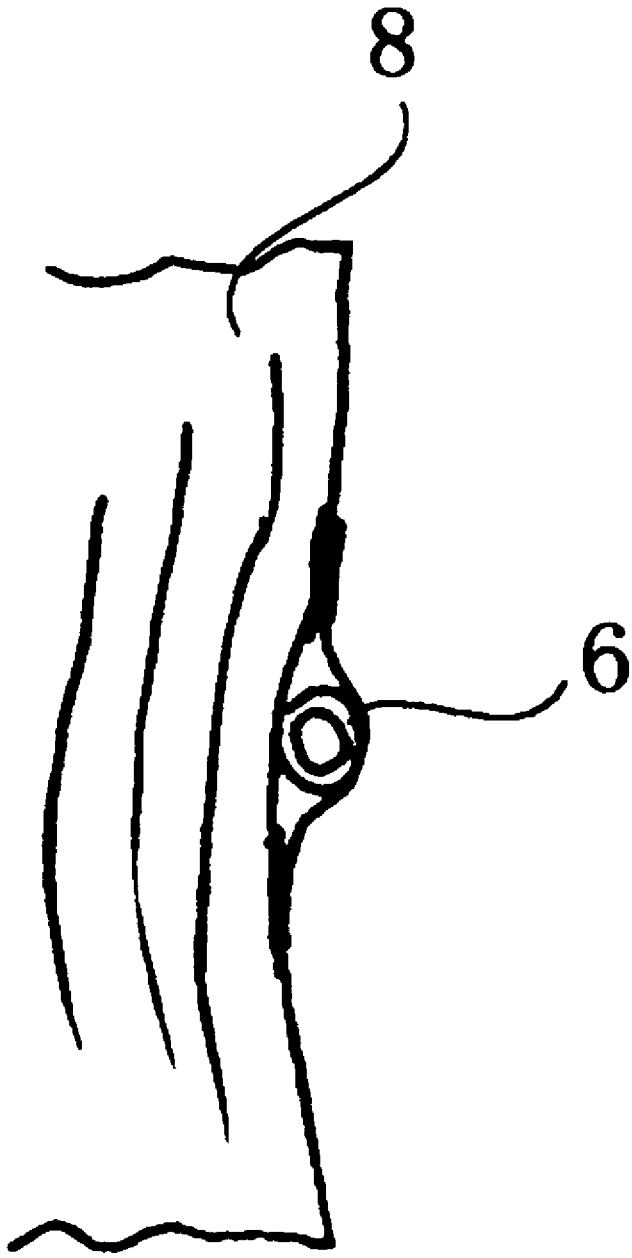
FIG. 2 is an enlarged view of a section of the flexible tube of FIG. 1.

Referring to FIG. 1, an escape device for use in building is shown which comprises a flexible tube 8, and a plurality of retractable elastic members 6 laterally and intermittently formed on the flexible tube 8. The flexible tube 8 is vertically oriented with a bracket 9 formed on a top portion thereof. An escape entrance 11 is formed thereon the bracket 9.

The flexible tube 8 is made of antisepsis, fireproofing fabric or unwoven fabric. The diameter of the flexible tube 8 is between 30 centimeters to 80 centimeters. The space between the adjacent elastic members 6 made of coil spring or snake-shaped spring is between 40 centimeters to 80 centimeters.

Figure 4:
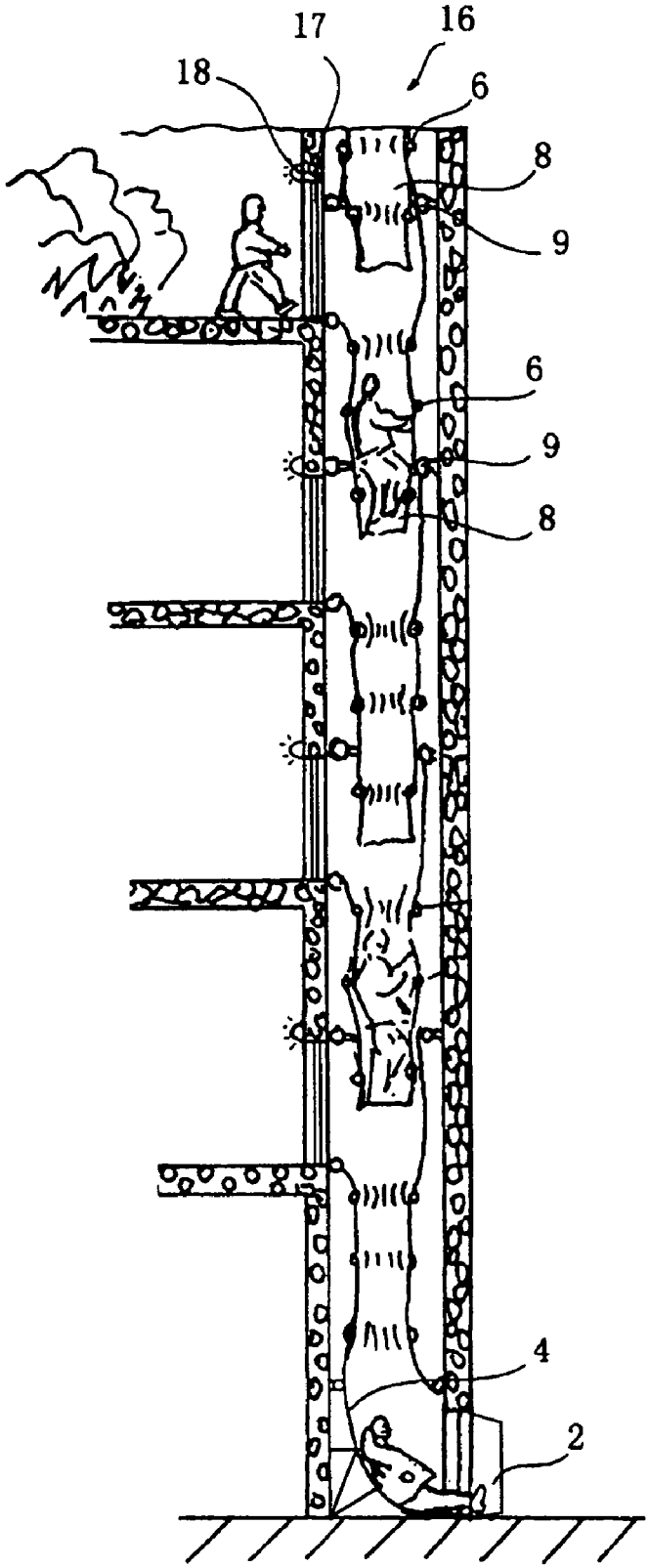
FIG. 4 illustrates, in a cross-sectional manner, an alternative embodiment of the chute-type escape device of FIG. 1.

FIG. 4 shows a preferred embodiment of the present invention wherein the vertically aligned flexible tubes 8 are positioned in escape channel 16 which is vertically opened in the multi-story building. One bracket 9 of the flexible tube 8 is disposed corresponding to one emergency exit 17 defined in each story of the multi-story building. The flexible tube 8 is hanged in the escape channel 16 by the bracket 9. A landing pad 4 is provided beneath the lowest flexible tube 8. A security gate 2 is on bottom of the escape channel 16. The escape entrance 11 is formed on a side of the bracket 9. A joint opening 15 is formed on the top of the bracket 9. The plurality of the flexible tubes 8 are vertically aligned so that bottom end of the upper flexible tube 8 extends across the joint opening 15 of the bracket 9 formed on the top portion of the lower flexible tube 8 and into the lower flexible tube 8.

As shown in FIG. 4, an escape indicating device 18 is provided on the emergency exit 17 defined in each story of the multi-story building.

Figure 3:
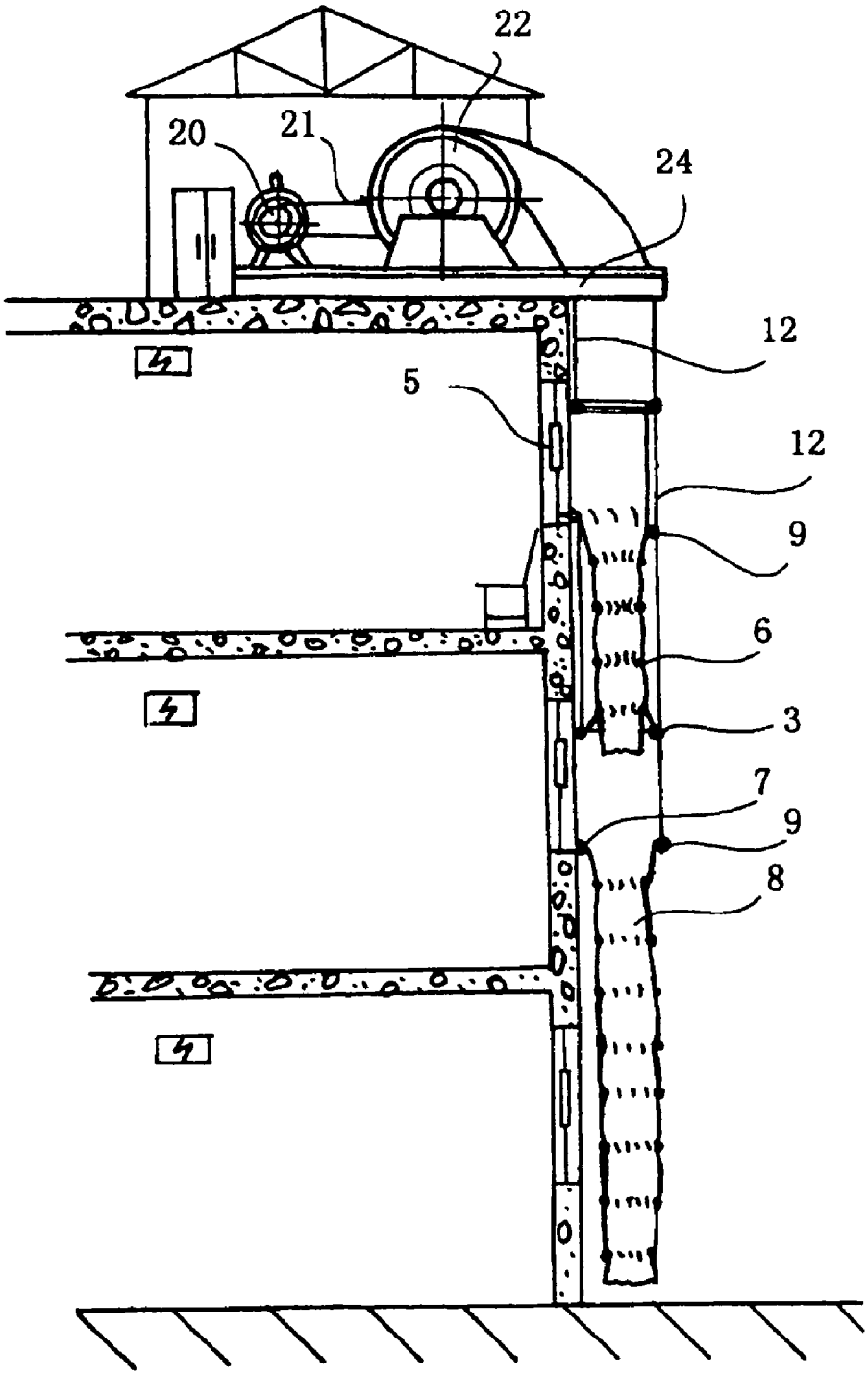
FIG. 3 illustrates, in a cross-sectional manner, a preferred embodiment of the chute-type escape device of FIG. 1.

FIG. 3 shows an alternative embodiment of the present invention wherein a base 24 is provided on the top floor of the building for supporting the escape device. The base 24 comprises an actuating device 20 and a reel 22 actuated by the actuating device through a transmission device 21. Tow rope 12 and the flexible tub 8 fixed and arranged parallel thereto are capable of being coiled on the reel 22. A top end of the flexible tube 8 is fixed on the tow rope 12 via the bracket 9, and a bottom end of the flexible tube 8 is fixed on the tow rope 12 via a fixing member 3. The plurality of the flexible tubes 8 are vertically aligned so that bottom end of the upper flexible tube 8 extends across the joint opening 15 of the bracket 9 formed on the top portion of the lower flexible tube 8 and into the lower flexible tube 8. Four tow ropes 12 arranged in parallel with each other are oriented outside of the flexible tube 8 in uniformity.

The escape entrance 11 of the flexible tube 8 is provided corresponding to window of the building. Hook shaped connecting member 7 is formed on the tow rope 12 for coupling with joining device provided on window or exit of the building.

The tow rope 12 of the alternative embodiment is preferably steel wire or fireproofing rope.

User can control the falling speed varied between 0 meter per second to 2.5 meters per second in the flexible tube 8 during escaping from the emergency.

It is to be understood, that the disclosure of the above-mentioned embodiments is illustrative only, and the present invention is not limited to the embodiments. The principles of the present invention to the full extent indicated by the broad general meaning of the terms in which the appended claims are expressed.

INDUSTRY UTILITY

The escape device of the present invention is used for people to escape from building when there is an accident, such as fire or explosion occurs in the building. Using the safety device according to the present invention, peoples can safely descend onto the ground without using other devices.

What is claimed is:

1. An escape device for use in a building comprising:

a plurality of flexible tubes (8);

a plurality of retractable elastic members (6) intermittently and laterally formed on the plurality of flexible tubes (8);

each of the plurality of flexible tubes (8) vertically oriented with a bracket (9) formed on a top portion thereof, the bracket (9) comprising an escape entrance (11) formed thereon; and wherein, the escape device is adapted to be secured on the building by the bracket (9), and the escape entrance (11) is formed on a side of the bracket (9), characterized in that a joint opening (15) is on a top of the bracket (9), at least one of the flexible tubes (8) and the plurality of the flexible tubes (8) are vertically aligned so that a bottom end of an upper flexible tube (8) extends across the joint opening (15) of the bracket (9) formed on a top portion of a lower flexible tube (8) and into a lower flexible tube (8).

2. The escape device as claimed in claim 1, wherein a base (24) is provided on the top floor of the building for supporting the escape device, the base comprises an actuating device (20) and a reel (22) actuated by the actuating device through a transmission device (21), at least two tow ropes (12) and the flexible tubes (8) fixed and arranged parallel thereon are capable of being coiled on the reel (22), atop end of the flexible tubes (8) is fixed on the tow ropes (12) via the bracket (9), and a bottom end of the flexible tubes (8) is fixed on the tow ropes (12) via a fixing member (3).

3. The escape device as claimed in claim 2, wherein the tow rope (12) has connecting member (7) for coupling with the joining device provided on window or exit of the building.

4. The escape device as claimed in claim 3, further comprising four tow ropes (12) arranged in parallel with each other which is oriented outside of the flexible tube (8) in uniformity, wherein said tow rope (12) is steel wire or fireproofing rope, and the connecting member (7) is hook shaped.

5. The escape device as claimed in claim 1, wherein the landing speed of user in the flexible tubes (8) varies between 0 meter per second to 2.5 meters per second.

6. The escape device as claimed in claim 1, wherein the flexible tube (8) is made of antisepsis, fireproofing fabric or unwoven fabric, and the diameter of the flexible tube (8) is between 30 centimeters to 80 centimeters, and the space between the adjacent elastic members (6) made of coil spring or snake-shaped spring is between 40 centimeters to 80 centimeters.

7. The escape device as claimed in claim 6, wherein a base (24) is provided on the top floor of the building for supporting the escape device, the base comprises an actuating device (20) and a reel (22) actuated by the actuating device through a transmission device (21), at least two tow ropes (12) and the flexible tubes (8) fixed and arranged parallel thereon are capable of being coiled on the reel (22), a top end of the flexible tubes (8) is fixed on the tow ropes (12) via the bracket (9), and a bottom end of the flexible tubes (8) is fixed on the tow ropes (12) via a fixing member (3).

8. An escape device for use in multi-story building comprising:

a plurality of flexible tubes (8);

a plurality of retractable elastic members (6) intermittently and laterally formed on the plurality of flexible tubes (8);

each of the plurality of flexible tubes (8) vertically oriented with a bracket (9) formed on a top portion thereof, the bracket (9) comprising an escape entrance (11) formed thereon; and wherein, the escape device is adapted to be secured on the building by the bracket (9), and the escape entrance (11) is formed on a side of the bracket (9), characterized in that a joint opening (15) is on a top of the bracket (9), at least one of the flexible tubes (8) and the plurality of the flexible tubes (8) are vertically aligned so that a bottom end of an upper flexible tube (8) extends across the joint opening (15) of the bracket (9) formed on a top portion of a lower flexible tube (8) and into a lower flexible tube (8), wherein the flexible tube (8) is made of antisepsis, fireproofing fabric or unwoven fabric, and the diameter of the flexible tube (8) is between 30 centimeters to 80 centimeters, and the space between the adjacent elastic members (6) made of coil spring or snake-shaped spring is between 40 centimeters to 80 centimeters, and wherein the vertically aligned flexible tubes (8) are positioned in an escape channel (16) vertically opened in the multi-story building, and one bracket (9) of the flexible tube (8) is disposed corresponding to one emergency exit (17) defined in each story of the multi-story building, the flexible tube (8) is adapted to be secured in the escape channel (16) by the bracket (9), and a landing pad (4) is provided beneath a lowest flexible tube (8), and a security gate (2) is on a bottom of the escape channel (16).

9. The escape device as claimed in claim 8, wherein an escape indicating device (18) is provided on the emergency exit (17) defined in each story of the multi-story building.

* * * * *